United States Patent [19]

Skrdlant et al.

[11] 4,369,566

[45] Jan. 25, 1983

[54] PROCESS OF PRODUCING FRONT COMMUTATORS FOR THE ROTORS OF DIRECT CURRENT MACHINES

[75] Inventors: Karel Skrdlant; Lubor Milota, both of Prague, Czechoslovakia

[73] Assignee: PIKAZ, inzenyrsky podnik, Prague, Czechoslovakia

[21] Appl. No.: 259,144

[22] Filed: Apr. 30, 1981

[30] Foreign Application Priority Data

Apr. 30, 1980 [CS] Czechoslovakia ..... 3055-80

[51] Int. Cl.[3] ..... H01R 43/08

[52] U.S. Cl. ..... 29/597; 29/418; 310/43; 310/237

[58] Field of Search ..... 29/597, 418; 310/237, 310/233–236, 43

[56] References Cited

U.S. PATENT DOCUMENTS 3,459,983 8/1969 Bowcott ..... 29/597 X 3,925,881 12/1975 Bowcott ..... 29/597

*Primary Examiner*—Carl E. Hall

[57] ABSTRACT

Process of producing front commutators for the rotors of direct current machines. A linear shaped copper strip is formed, the shaped strip incorporating a plurality of serially connected commutator segment halves. After the formation of the shaped strip it is alternately bent in an upward direction and in a downward direction to form a intermediate product in which the upper surfaces of the segment halves of each pair thereof are pressed together. The resulting intermediate product is then bent into a circle so that there is formed a commutator ring with a plurality of confronting pairs of segment halves disposed in radial directions. Between the bent, initially upper shaped parts of the shaped strip there are formed slots for the reception of the rotor winding between confronting segment halves; and between the bent, initially lower linear parts of the shaped strip there are formed air gaps between the consecutive segments of the commutator.

6 Claims, 11 Drawing Figures

FIG. 6
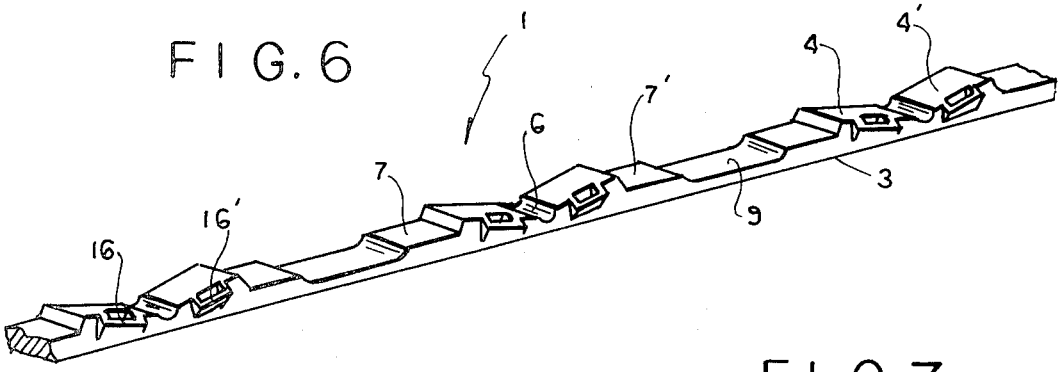
FIG. 7
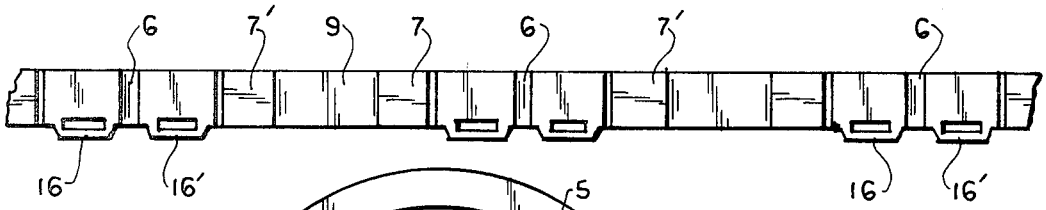
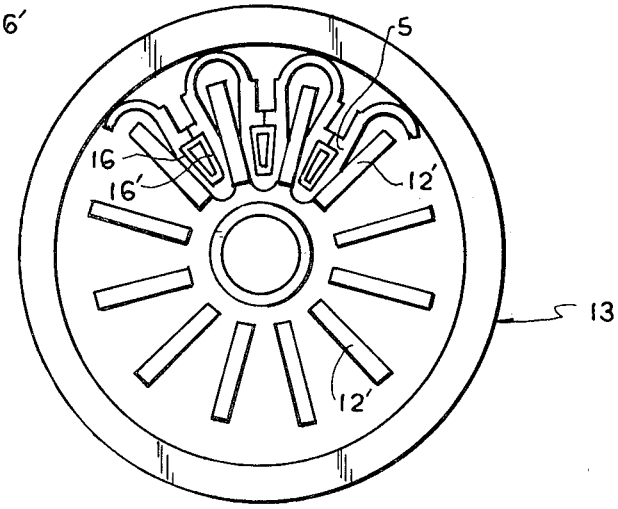
FIG. 8
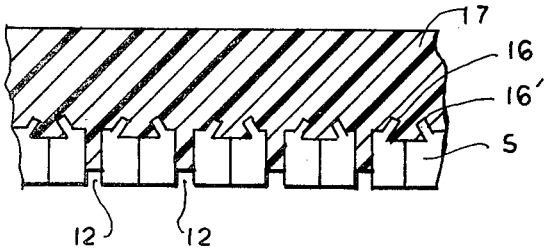
FIG. 9

FIG. 10
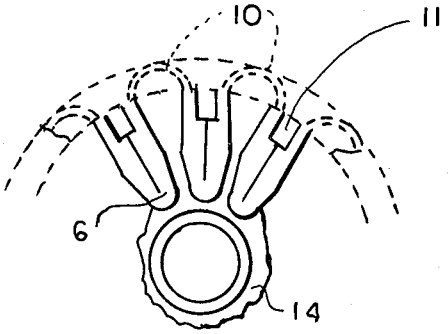
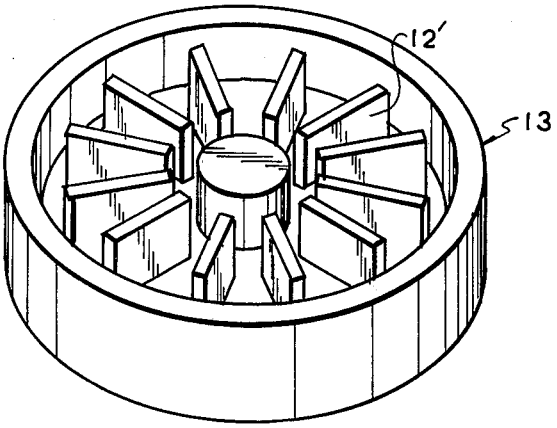
FIG. 11

PROCESS OF PRODUCING FRONT COMMUTATORS FOR THE ROTORS OF DIRECT CURRENT MACHINES

This invention relates to a process of producing front commutators for rotors of direct current machines. The advantages of front commutators are especially the smaller consumption of commutator copper and the smaller total length of the machinery as a result of the shorter length of the commutator as compared with commutators of classical construction.

The known processes of producing front commutators involve the production of single segments provided with catching means, and the assembling in the so-called commutator ring, which is then sprayed with artificial electrically insulating resin, and then completed by a known process. The commutator intermediate product can be designed as a circular plate provided with catches for segments with gaps formed between single segments, the gaps being of such depth that the segments still form a monolithic unit. The commutator intermediate product is then sprayed with artificial resin, and the single segments of the commutator are separated by subsequent working. Both processes are complicated, and involve considerable waste of copper; it is still necessary to mill slots in the commutator for the reception of the rotor winding. In the case in which the starting intermediate product is a circular ring, working out the slots for inter-segment isolation is difficult and complicated.

The above-recited drawbacks are eliminated by the process of producing front commutator segments of the rotors of direct current machinery of the present invention. In accordance with the invention, first, shaped strip is formed by an operating process, using a pressing forming tool, from stripped commutator copper in one piece, thereby forming a single strip in an intermediate state having a lower surface which is mostly linear, and an upper part which is shaped. The upper part for each segment always contains two level parts which include an obtuse angle between them. Between both level parts there is formed a cut-out for bending in the narrowest section of the shaped strip, and at the ends of both level parts there is formed a slot in the widest section of the shaped strip for receiving the rotor winding. Such slot is connected by a connecting strap with the slot of a further segment. The segments are provided with fastening catches on their side areas. Bending and twisting of the shaped strip is carried out so that the shaped strip is alternately bent in an upward direction at the location of the cut-outs for bending, and in a downward direction in the locations of the connecting straps, both level parts being always pressed together. The resulting intermediate product is coiled into a circle so that there is formed a commutator ring with the single segment parts disposed radially; between the bent, initially upper shaped parts of the shaped strip there are formed slots for receiving the rotor winding between single segments, and between the bent, initially lower linear parts of the shaped strip there are formed air gaps between successive segments. Such gaps are potted with casting electrically insulating plastic material after the insertion and location of the thus formed commutator ring in the mold of an extrusion machine. The commutator ring is extracted from the mold after the hardening of the casting material, and the connecting straps at the external commutator surface are removed by a mechanical process so that the successive segments are separated; the commutator is then completed by a conventional process. The location of the circularly bent intermediate product in the extrusion machine, according to one embodiment of the process of the invention, is accomplished by using cores having the thickness and height of the desired air gap.

The process of forming front commutator segments in accordance with the invention is illustrated in the attached drawings wherein:

FIG. 6 is a view in perspective of the initially shaped strip shown in FIG. 1;

FIG. 7 is a plan view of the strip shown in FIGS. 1 and 6;

FIG. 8 is a view in plan of the mold in which the intermediate product of FIG. 3 is placed;

FIG. 9 is a view showing the product in the same manner as in FIG. 4, the product having been removed from the mold;

FIG. 10 is a fragmentary view in end elevation of the semi-product, the view showing in dashed lines the manner in which the peripheral portion of the product is mechanically removed to separate successive segments of the commutator from each other;

and

FIG. 11 is a view in perspective of the mold shown in FIG. 8.

Figure 1:
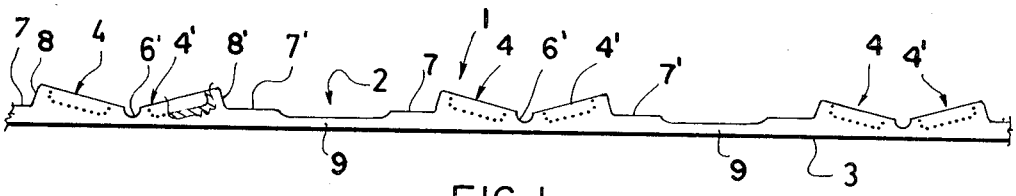
FIG. 1 is a fragmentary view in side elevation of an initially shaped strip which is to be formed into a plurality of commutator segments.

The process of producing front commutator segments for the rotors of direct current machinery according to the invention begins with the formation of a strip 1 (FIG. 1) of an electrically conducting metal such as copper. Strip 1 is formed in one piece by an operating process with the help of a pressing forming tool. Strip 1 has a shaped upper surface, generally designated 2, and a flat lower surface 3. In FIG. 1 there are shown three sets of pairs of segment halves, the left-hand segment half of each pair being designated 4, and the right-hand segment half of each pair being designated 4'. Between the left-hand and right-hand segment halves of each pair of segment halves there is provided a thin section or bending notch 6'. To the left of each segment half 4 there is a plateau 7 of intermediate thickness, and to the right of each segment half 4' there is a plateau 7' of intermediate thickness. The upper surfaces of each of parts 4 and 4' of each pair of segment halves are flat and form an obtuse angle between them. Each plateau 7 is connected to the higher, left-hand end of the upper surface of its corresponding part 4 by a shoulder 8, and each plateau 7' is connected to the higher, right-hand end of the upper surface of its corresponding part 4' by a shoulder 8'. It will be seen that the left-hand segment half 4 and the right-hand segment half 4' of each pair of segment halves are mirror images of each other. The plateaus 7 and 7' of consecutive pairs of segment halves are connected by a strip 9 which is thin in a vertical direction as shown in FIG. 1. As shown, each left-hand segment half 4 has a fasten catch or angularly directed ear 16, and each right-hand segment half 4' has an oppositely bent catch or ear 16'. As will be apparent later, such catches or ears become embedded in the potting resin which is cast in and about the bent intermediate product, and thus aid in mechanically securing the commutator segments in the potting resin.

Figure 2:
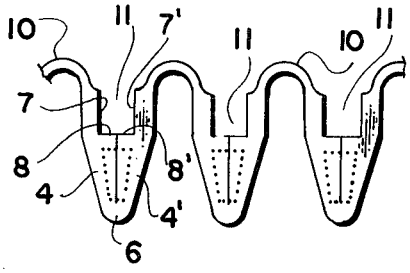
FIG. 2 is a fragmentary view of the strip of FIG. 1 after it has been initially bent into a folded shape which lies generally in a straight line.

The length of strip formed as shown in FIG. 1 and as above described is then bent and folded as shown in FIG. 2 in such way that the shaped strip 1 is alternately bent in an upward direction at the locations of the cut-outs or bending notches 6' and in the opposite direction in the location of the connecting strips or straps 9. In FIG. 2, the bent connecting strips, now designated 10, lie at the top, and the portion of the strip at the bending notches 6', now designated 6, lie at the bottom. The formerly upper, inclined surfaces of the segment halves 4 and 4' lie in abutment with each other in FIG. 2. The shoulders 8 and 8' in FIG. 2 lie in a single plane, and the plateau 7 and 7' lie parallel, with a space 11 between them. Space 11 forms a groove for receiving the winding of the rotor in the finished commutator.

Figure 3:
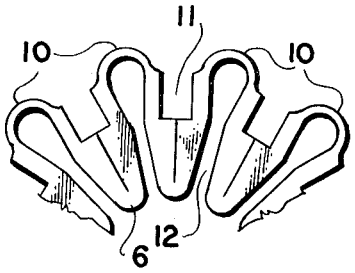
FIG. 3 is a fragmentary view in side elevation of the folded intermediate product of FIG. 2 after it has been bent into a circle having the diameter of the commutator to be eventually formed.
Figure 4:
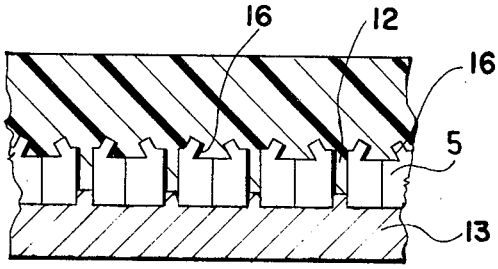
FIG. 4 is a fragmentary view in section of a development of the intermediate product or blank of FIG. 3 located in a mold of an injection molding machine, the figure showing the intermediate product a portion of a mold in which the semi-product is located, and a part of the potting resin which has been molded about the semi-product.
Figure 5:
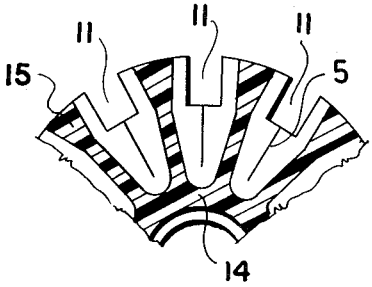
FIG. 5 is a fragmentary view partially in end elevation and partially in transverse section through a finished commutator resulting from the steps illustrated in FIGS. 1–4, inclusive.

The strip 1, after having been bent into the form shown in FIG. 2, is then further bent into a ring, with each pair of parts 4, 4' being disposed radially, successive pairs of parts 4 and 4' being separated by air gaps 12. The ring (FIG. 3) is now placed in an injection mold which has therein a mold core 13, shown in FIGS. 8 and 11. The mold core 13 has a bottom, an upstanding circular cylindrical peripheral ring, and a plurality of upstanding radially directed core members 12' secured to the bottom of the core. As shown in FIG. 4, the radial core parts 12', which preserve the desired air gaps 12, are relatively short, so that the predominant part of the space between successive commutator segments is filled with casting resin integral with the radial spokes 17, formed of casting resin, disposed between successive segments. Also integral with the spokes 17 is a generally circular portion 14 formed of said electrically insulating curable resin which is injected into the mold of which the core 13, bearing the semi-product of FIG. 3, is a part.

After the casting resin has cooled and solidified, the connecting portions 10 between the radially outer portions of successive commutator segments are now cut off, as shown in FIG. 10, by mechanically removing the material including the connecting portions 10 and the radially outer portion of the cast resin which is included between the inner and outer circles depicted by the fragmentary dash-line circles in FIG. 10.

The process of producing commutators according to the invention permits the employment of highly mechanized or automated production equipment with the possibility of continuous production of the product with minimal requirements for copper consumption and labor. The process further allows various manners of intersegment insulation, which can be formed either by inserting insulating packings between successive segments or can be made, as above described, directly by injection molding or casting. The depth of penetration of the casting material between the commutator segments can be determined so that the casting material will be disposed beneath the active part of the commutator segments. A further advantage of the process of producing commutator segments according to the present invention is the fact that by additional working of the commutator surface the layer of cast material is not fractured in its entirety, and that the so-called absorbability of the casting material is not damaged, because it is not necessary to remove the harder outer surface layer (glaze) which protects the desired properties of the cast resin material.

Although the invention is illustrated and described with reference to one preferred embodiment thereof, it is to be expressly understood that it is in no way limited to the disclosure of such preferred embodiment but is capable of numerous modifications within the scope of the appended claims.

We claim:

1. A process of producing front commutators for the rotors of direct current machines, comprising forming a linear shaped copper strip, said shaped strip incorporating a plurality of serially connected pairs of segment halves, the halves of each pair being mirror images of each other, the shaped strip having a generally flat lower surface and an upper part which is shaped into said plurality of connected pairs of segment halves, the segment halves of each pair thereof having plane parts which include an obtuse angle between them, a cut-out portion in the upper part of the shaped strip between the two segment halves of each pair thereof, successive pairs of segment halves being connected by a thin section of the shaped strip, the parts of the strip between each successive pair of segment halves and outwardly from the slots at the ends of the segment halves in each pair thereof connected by a strap having plateaus of reduced height; after the formation of said shaped strip bending it alternately in an upward direction in the locations of the cut-outs for bending and in a downward direction in the locations of the connecting straps to form an intermediate product in which both plane upper surfaces of the segment halves of each pair thereof are pressed together and the plateaus of reduced height form a groove for receiving a rotor winding, and further bending the resulting intermediate product into a circle so that there is formed a commutator ring with a plurality of confronting pairs of segment halves disposed in radial directions; between the bent, initially upper shaped parts of the shaped strip there being formed slots for the reception of the rotor winding between confronting segment halves; and between the bent, initially lower linear parts of the shaped strip there being formed air gaps between the consecutive segments of the commutator.

2. A process according to claim 1, wherein the segment halves are provided with fastening catches on their side areas.

3. A process according to claim 1, comprising potting the gaps between consecutive segments with plastic material after the insertion and location of the commutator ring in the mold of an extrusion machine, and removing the potted commutator ring from the mold after the hardening of the potting material.

4. The process according to claim 1, comprising removing the connecting straps at the external commutator surface so that the commutator segments are separated and insulated from each other by the potting material.

5. A process according to claim 1, wherein the location of the segment halves in the extrusion machine is effected by the use of a core having portions which project therefrom and partially enter the spaces between successive commutator segments.

6. A process according to claim 1, wherein the segment halves are provided with fastening catches on their side areas, said catches being embedded in the plastic potting material in the finished commutator.

* * * * *